US009150967B2

(12) United States Patent
Watanabe et al.

(10) Patent No.: US 9,150,967 B2
(45) Date of Patent: Oct. 6, 2015

(54) PLASMA PROCESSING APPARATUS AND SAMPLE STAGE

(75) Inventors: Tomoyuki Watanabe, Kudamatsu (JP); Mamoru Yakushiji, Shunan (JP); Yutaka Ohmoto, Hikari (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 885 days.

(21) Appl. No.: 12/854,242

(22) Filed: Aug. 11, 2010

(65) Prior Publication Data

US 2011/0297082 A1 Dec. 8, 2011

(30) Foreign Application Priority Data

Jun. 7, 2010 (JP) ..... 2010-129522

(51) Int. Cl.
*C23C 4/00* (2006.01)
*C23C 28/00* (2006.01)
*C23C 4/02* (2006.01)

(52) U.S. Cl.
CPC .. *C23C 28/00* (2013.01); *C23C 4/02* (2013.01)

(58) Field of Classification Search
USPC ..... 156/345.52; 118/724, 725, 663; 361/234; 279/128
See application file for complete search history.

(56) References Cited

U.S. PATENT DOCUMENTS

| | | | | |
|---|---|---|---|---|
| 6,166,897 | A * | 12/2000 | Matsunaga | 361/234 |
| 2002/0036881 | A1* | 3/2002 | Shamouilian et al. | 361/234 |
| 2006/0076108 | A1* | 4/2006 | Holland et al. | 156/345.27 |
| 2006/0144516 | A1* | 7/2006 | Ricci et al. | 156/345.27 |
| 2011/0297082 | A1* | 12/2011 | Watanabe et al. | 118/663 |

FOREIGN PATENT DOCUMENTS

JP 2008-300491 12/2008

OTHER PUBLICATIONS

Machine Generated English Translation of JP 2008-300491 published Dec. 11, 2008.*

* cited by examiner

*Primary Examiner* — Sylvia R MacArthur
(74) *Attorney, Agent, or Firm* — Baker Botts L.L.P.

(57) ABSTRACT

A plasma processing apparatus includes a metallic basic material arranged in a sample stage, a dielectric film of dielectric material disposed on an upper surface of the basic material, the dielectric film being formed through a plasma spray process; a film-shaped heater disposed in the dielectric film, the heater being formed through a plasma spray process; an adhesive layer arranged on the dielectric film; a sintered ceramic plate having a thickness ranging from about 0.2 mm to about 0.4 mm, the sintered ceramic plate being adhered onto the dielectric film by the adhesive layer; a sensor disposed in the basic material for sensing a temperature; and a controller for receiving an output from the sensor and adjusting quantity of heat generated by the heater.

8 Claims, 4 Drawing Sheets

PLASMA PROCESSING APPARATUS AND SAMPLE STAGE

BACKGROUND OF THE INVENTION

The present invention relates to a plasma processing apparatus for processing a wafer placed in a processing chamber in a vacuum vessel by use of plasma generated in the processing chamber, and in particular, to a plasma processing apparatus in which the wafer is processed while adjusting temperature of a sample stage disposed in the processing chamber to thereby adjust temperature of the wafer suitable for the processing.

Such plasma processing apparatus processes a so-called multilayered film including a plurality of films which are objects of the processing and which are formed in a surface of a sample having a contour of a substrate, for example, a semiconductor wafer. To minimize the period of time required to process the multilayered film, it has been considered to process films vertically adjacent to each other of the wafer in the same processing chamber without moving the wafer to the outside of the processing chamber between the processing phases respectively of the adjacent films. It has been required to conduct finer manufacturing of a wafer with high precision. To obtain higher uniformity in the contour of the wafer in the surface direction (radial and circumferential directions) thereof after the manufacturing processes of the wafer, for example, after the films of the wafer are etched, the wafer temperature is adjusted for each film to be suitable for the associated processes in the prior art.

A technique to adjust the wafer temperature has been described in, for example, JP-A-2008-300491. According to the technique, a disk-shaped ceramic member and a heater disposed therebelow to be connected to the ceramic member are arranged in an upper section of a sample stage, the upper section providing a surface on which a wafer is to be placed. By adjusting quantity of heat generated by the heater, the temperature of the ceramic disk member and that of the wafer disposed on an upper surface of the disk-shaped ceramic member are set to temperature values suitable for the associated processes. In JP-A-2008-300491, the disk-shaped ceramic member includes therein an electrode to receive direct-current (dc) power to generate electrostatic force to chuck the wafer onto the upper surface thereof. On a lower surface of the disk-shaped ceramic member, a film-type heater having a predetermined thickness is formed. Peripheral sections of the heater are coated with resin adhesive. A side section of the disk-shaped ceramic member coated with the adhesive is pushed against an upper surface of the main section made of conductive material of the sample stage with the adhesive therebetween, to thereby form the sample stage.

The heater includes a material prepared by mixing conductive material and semiconductor material with a heatproof resin and is supplied with power via a connector disposed in a through hole arranged in the main section of the sample stage. The sample stage is constructed such that two areas, i.e, an area near a central section of the sample stage and an area in a circumferential section thereof are supplied via respective connectors with respectively different values of power. Hence, in each of the sample stage and the wafer arranged thereon, the temperature distribution varies between the central section and the circumferential section thereof.

SUMMARY OF THE INVENTION

In the sample stage of the prior art, to improve precision in the distribution of temperature of the wafer suitable for the processing and to improve uniformity of the wafer temperature, the heater arranged in the disk-shaped ceramic member in the surface of the sample stage is subdivided into a plurality of areas. The quantity of heat generated by the heater is adjusted such that the temperature of the surface of the ceramic member is set or controlled to a desired value for each of the areas. Additionally, in each of the subdivided areas in which a plurality of heaters are disposed, to keep uniformity in the quantity of heat generated by the associated heater and to improve uniformity in the temperature in the surface direction of the wafer, the ceramic member is increased in its thickness. This increases heat capacity thereof to provide heat uniformalizing effect to reduce difference or variation in the temperature. Also, in the disk-shaped ceramic member, a plate-shaped member made of a material having high heat conductivity, for example, a metallic material is disposed to increase quantity of heat transferred through the ceramic member. This reduces the temperature variation on the surface of the ceramic member to thereby improve uniformity of the wafer temperature.

To adjust the quantity of heat generated by the heater, it is required to sense a reference temperature. However, it is difficult to directly measure the wafer temperature with high accuracy. Hence, according to the prior art, a sensing unit such as a temperature sensor is disposed in the metallic member forming section of the basic material in the upper section of the sample stage, the metallic member forming section being in the vicinity of the heater. Based on the temperature determined by an output from the sensing unit, power supplied to the heater and the quantity of heat generated by the heater are adjusted such that the temperature of the wafer or the surface temperature of the sample stage is controlled in a desired temperature range.

However, by increasing the thickness of the disk-shaped ceramic member and by installing the heat uniformalizing plate in the ceramic member, the distance between the heater and the wafer becomes larger. This increases heat capacity of the ceramic member, the heat capacity affecting the operation to change the temperature by the heater. Hence, even if the quantity of heat generated by the heater is adjusted to change the temperature of each film to an appropriate temperature during the wafer process, the response time from when the heat quantity is adjusted to when the adjustment reflects in the temperature of the ceramic member surface or the wafer temperature becomes longer. This leads to a fear that the difference between the appropriate temperature and an actual wafer surface temperature becomes greater during the wafer process. Hence, when it is desired to continuously process a section ranging from a hard mask to a metallic layer, precision of the wafer process is lowered. For example, the CD (critical dimension) of the metallic layer becomes thinner. Also, according to the prior art, consideration has not been fully given to a problem in which thermal resistance becomes higher between the temperature sensor disposed in the sample stage and the wafer placed thereon and the temperature difference between the temperature from the temperature sensor in the sample stage and the actual wafer temperature becomes larger. This resultantly lowers the precision in the wafer temperature adjustment.

It is therefore an object of the present invention to provide a plasma processing apparatus and a sample stage wherein the temperature adjustment precision is improved by changing the wafer temperature at a higher rate or in a shorter period of time to thereby improve wafer processing efficiency.

According to the present invention, the object is achieved by a plasma processing apparatus in which a wafer is placed on a sample stage disposed in a processing chamber in a vacuum vessel and the wafer is processed by use of plasma generated in the processing chamber. The plasma processing apparatus includes a metallic basic material arranged in the sample stage, a dielectric film of dielectric material disposed on an upper surface of the basic material, the dielectric film being formed through a plasma spray process; a film-shaped heater disposed in the dielectric film, the heater being formed through a plasma spray process; an adhesive layer arranged on the dielectric film;

a sintered ceramic plate having a thickness ranging from about 0.2 mm to about 0.4 mm, the sintered ceramic plate being adhered onto the dielectric film by the adhesive layer; a sensor disposed in the basic material for sensing a temperature; and a controller for receiving an output from the sensor and adjusting quantity of heat generated by the heater.

Also, the object is achieved by the plasma processing apparatus, further including an electrostatic-chuck electrode film disposed in or on a lower surface of the sintered plate for conducting an electrostatic-chuck operation.

Other objects, features and advantages of the invention will become apparent from the following description of the embodiments of the invention taken in conjunction with the accompanying drawings.

DESCRIPTION OF THE EMBODIMENT

Figure 1:
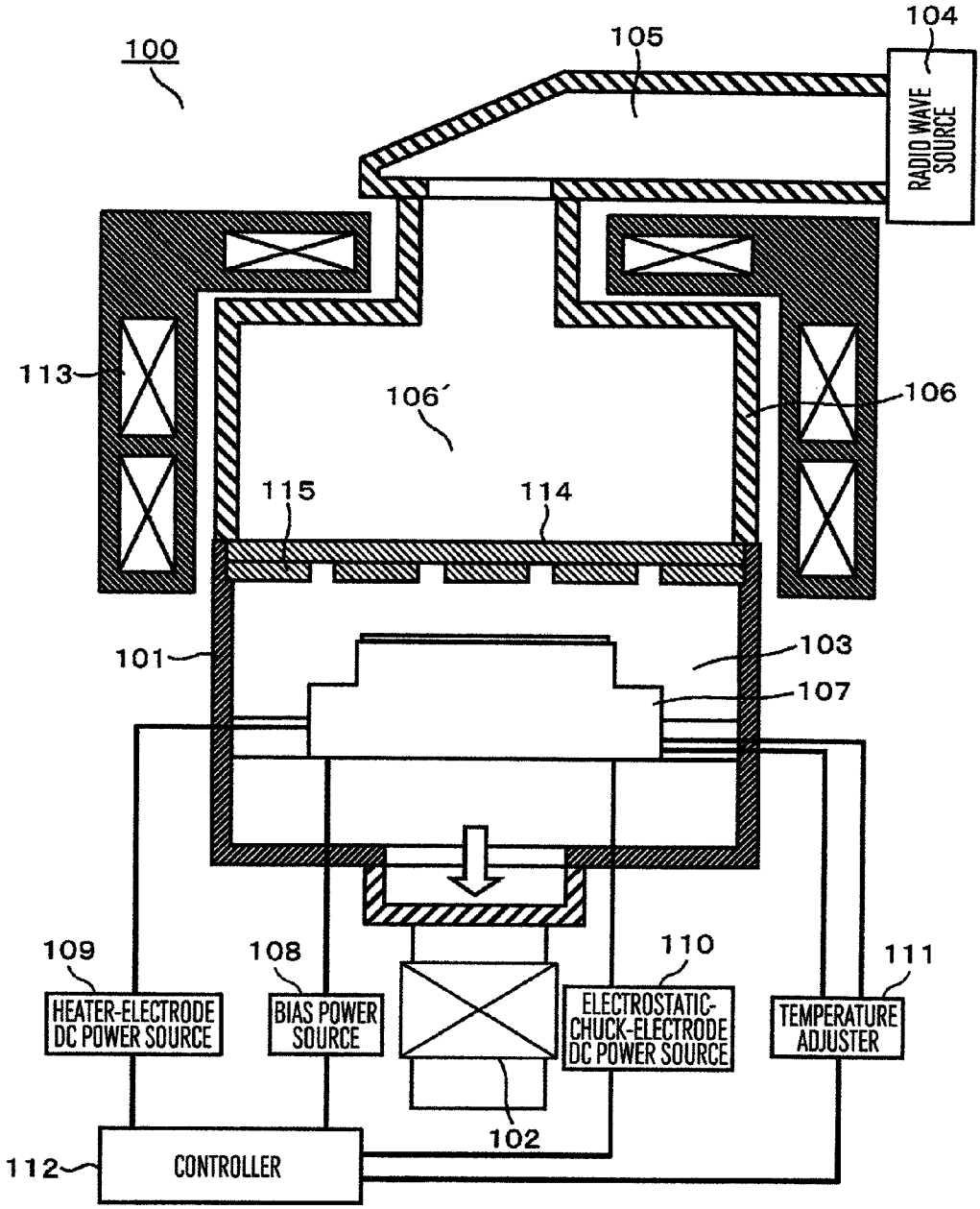
FIG. 1 is a view of a longitudinal section showing an outline of a plasma processing apparatus in an embodiment of the present invention.

Referring now to the drawings, description will be given of an embodiment according to the present invention.

FIG. 1 is a view of a longitudinal section to explain an outline of a configuration of a plasma processing apparatus according to the present invention. The plasma processing apparatus 100 shown in FIG. 1 includes a vacuum vessel 101, an electromagnetic field supply unit disposed at a position over the vacuum vessel 101, the position being in an outer periphery thereof, to supply an electric field or a magnetic field to the vacuum vessel 101, and an exhaust unit disposed below the vacuum vessel 101 to exhaust gases therefrom.

In the vacuum vessel 101, there are arranged a processing chamber 103 in which plasma is generated and a sample as a processing object is processed by the plasma and a sample stage 107 having a surface on which the sample is placed and is held. Over the vacuum vessel 101, there are arranged a radio wave source 104, for example, a magnetron as an electromagnetic field supply unit to produce an electric field of a predetermined frequency, for example, a microwave or a UHF wave, a waveguide 105 as a pipeline which propagates and guides a radio wave to the processing chamber 103, and a resonance vessel 106 connected to the waveguide 105. The radio wave is propagated through the waveguide 105 and is guided into the resonance vessel 106 to resonate in a space therein.

Over the vacuum vessel 101, a solenoid coil 113 is arranged around an outer periphery of an upper section of the cylindrical vacuum vessel 101. By receiving a current, the solenoid coil 113 generates a magnetic field. In the embodiment, the solenoid coil 113 includes a plurality of stages to provide the inside of the processing chamber 103 with a uniform magnetic field having a contour of axial symmetry about a central axis in the vertical direction of the processing chamber 103, the magnetic field expanding in the downward direction.

Below the vacuum vessel 101, a vacuum pump 102 is disposed as an exhaust unit such as a turbo-molecular pump. The vacuum pump 102 is connected to a circular exhaust opening arranged below the processing chamber 102 in the vacuum chamber 101, the circular exhaust opening being just beneath the sample stage 107. The processing chamber 102 in the vacuum chamber 101 has substantially a cylindrical contour. In a lower central section of the processing chamber 103 and over the opening, there is disposed a substantially cylindrical sample stage 107 on which a wafer is placed.

In the embodiment, the processing chamber 103, the sample stage 107, and the opening are vertically arranged such that the axes thereof are aligned with each other. A space between an outer wall of the sample stage 107 and an inner wall of the processing chamber 103 has a shape of a ring having an aligned axis as above. The sample stage 107 is supported in a space over the opening by use of a plurality of beams which horizontally extend from the outer wall toward the outer side. The beams are arranged in a contour of axial symmetry about a central axis in the vertical direction of the sample stage 107.

Over the cylindrical processing chamber 103, there is disposed a resonance chamber 106' which is a space for resonance in the cylindrical resonance vessel 106 with the axes thereof aligned with each other. Between the resonance chamber 106' and the processing chamber 103, there is disposed a disk-shaped window member 114 made of a dielectric material such as quartz, the window member 114 forming a bottom surface of the resonance chamber 106'. The window member 114 hermetically seals the resonance chamber 106' and the processing chamber 103.

Below the window member 114, there is arranged a disk-shaped shower plate 115 made of a dielectric material such as quartz in parallel with a lower surface of the window member 114 with a space therebetween. A lower surface of the shower plate 115 serves as a top surface of the processing chamber 103. The shower plate 115 is arranged in parallel with an upper surface of the sample stage 107 to oppose the upper surface thereof. In a central section of the shower plate 115, there are disposed a plurality of through holes through which process gases to process a wafer are delivered from above into the processing chamber 103. In a gap between the window member 114 and the shower plate 115, there are communicatively connected pipelines to flow process gases supplied from a gas source, not shown, arranged in a room such as a clean room in which the plasma processing apparatus 100 is installed. Wafer process gases from the gas source are guided through the pipelines into the gap and then flow through the pipelines into the processing room 103 toward the sample stage 107 in a lower section of the processing room 103.

The sample stage 107 includes therein an electrode made of a conductive material. The electrode is electrically connected to a bias power source 108 which outputs high-frequency power with a predetermined frequency. With a wafer placed on an upper surface, i.e., a sample mounting surface of the sample stage 107, a bias voltage is induced on the wafer surface by the high-frequency power supplied from the bias power source 108. Due to a voltage difference between the wafer surface and plasma generated in the processing chamber 103 over the sample stage 107, charged particles are attracted to the upper surface of the wafer.

The sample stage 107 also includes therein a heater to adjust the surface temperature of the sample mounting surface or the wafer temperature. The heater is electrically coupled with a heater-electrode dc power source 109 which supplies the heater with power. In the upper section of the sample stage 107, there is arranged a dielectric film which forms the sample mounting surface and which is made of a dielectric material, e.g., $Al_2O_3$ or $Y_2O_3$. In the dielectric film, there is disposed an electrostatic-chuck electrode to chuck a wafer onto a surface of the dielectric film by electrostatic force. The dielectric film is electrically connected to an electrostatic-chuck-electrode dc power source 110 which supplies the dielectric film with dc power.

During the wafer process, heat is transferred from the plasma to the sample stage 107. Hence, the temperature of the sample stage 107 goes up. To appropriately adjust the temperature of the sample stage 107, refrigerant paths which are supplied with refrigerant and which flow the refrigerant therethrough are concentrically or helically arranged about a central axis in the vertical direction of the sample stage 107. The refrigerant paths include a refrigerant entry and a refrigerant exit which are connected to pipelines for refrigerant. The pipelines are coupled with a temperature adjuster 111 to adjust temperature of the refrigerant. The refrigerant flows via a refrigerant path in the sample stage 107 and a pipeline outside thereof into the temperature adjuster 111. The temperature of the refrigerant is adjusted to a predetermined temperature by the temperature adjuster 111. The refrigerant is then supplied again via a pipeline to the refrigerant path in the sample stage 107. In this way, the refrigerant circulates in the plasma processing apparatus 100.

The constituent components of the plasma processing apparatus 100 are coupled via a communication unit with a controller 112 to control operation thereof. The controller 112 appropriately adjusts operation of each constituent component. The controller 112 includes a storage such as a memory, an arithmetic unit, and a communication connector, not shown. The controller 112 receives signals outputted from sensors as sensing units disposed at a plurality of positions of the plasma processing apparatus 100. Based on the signals, the controller 112 produces instructions by the arithmetic unit and sends the instructions to the associated constituent components, to thereby control operations of the constituent components for expected results.

According to the embodiment constructed as above, while an inert gas such as argon is being fed from a gas source to the processing chamber 103, the gas is exhausted therefrom by an exhaust unit to lower the pressure in the processing chamber 103. In this state, a wafer is transferred by a transfer unit such as a robot arm, not shown, via a gate, not shown, to the sample stage 107 and is passed thereto. The wafer is mounted on a dielectric film serving as a wafer mounting surface of the sample stage 107. The electrode disposed in the dielectric film is supplied with power from the electrostatic-chuck-electrode dc power source 110, which causes electrostatic force. The wafer is chucked by the electrostatic force and is held on the dielectric film.

While process gases are being fed from the gas source via the through holes of the shower plate 115 to the processing chamber 103, the gases are exhausted by the vacuum pump 102 via the opening. According to a ratio between the volume of gases fed to the processing chamber 103 and that of gases exhausted by the vacuum pump 102, the pressure in the processing chamber 103 is adjusted to a value in a predetermined range. A microwave generated by the radio wave source 104 propagates through the waveguide 105 and reaches the resonance vessel 106. As a result, an electric field of predetermined intensity is formed in the resonance chamber 106' in the resonance vessel 106. The electric field is supplied via the window member 114 and the shower plate 115 to the processing chamber 103.

Due to interaction between the magnetic field generated by the solenoid coil 113 and the electric field supplied from the resonance vessel 106, the process gases are excited into plasma. As a result, plasma is generated in a space over the sample stage 107 in the processing chamber 103. The bias voltage formed by the high-frequency power from the bias power source 108 attracts charged particles of the plasma to the surface of the wafer to conduct a predetermined process, for example, an etching process through physical and chemical reactions to form a film as a processing object on the wafer surface.

In the embodiment, the plasma is generated by ECR (Electron Cyclotron Resonance) using the interaction between the electric field by the microwave and the magnetic field. However, the present invention is not restricted by the embodiment, but it is also possible to employ a plasma generating unit including an electrostatic coupling unit or an inductive coupling unit using a high frequency.

Figure 2:
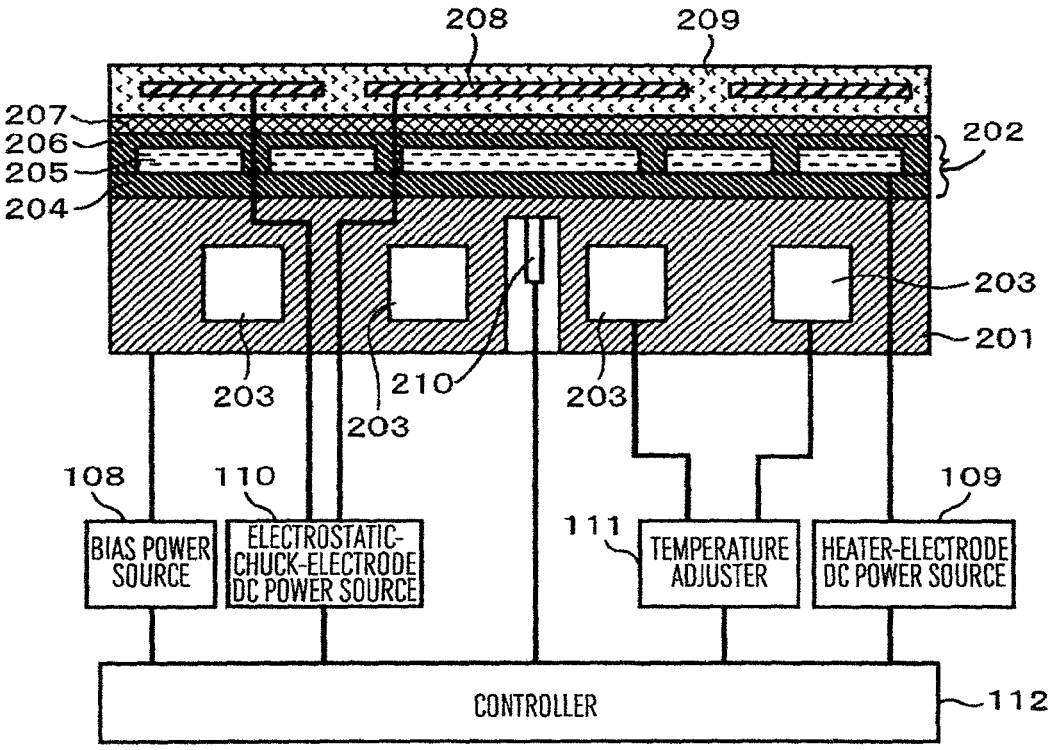
FIG. 2 is an enlarged view of a longitudinal section showing structure of a sample stage in the embodiment shown in FIG. 1.

FIG. 2 is a view of a longitudinal section showing an enlarged configuration of the sample stage of the embodiment shown in FIG. 1. That is, FIG. 2 shows the structure of the sample stage 107 in detail.

The sample stage 107 includes a disk-shaped basic section 201 made of a metallic material, e.g., aluminum or titanium and a dielectric film section 202 which is made of a dielectric material, e.g., $Al_2O_3$ and which is fixed on an upper surface of the basic section 201. The dielectric material includes therein a heater and an electrostatic-chuck electrode. In the basic section 201, refrigerant channels or paths 203 to pass refrigerant to cool the basic section 201 are concentrically or helically arranged about a central axis in the vertical direction of the basic section 201. The refrigerant paths 203 include an entry to be supplied with refrigerant and an exit to discharge refrigerant which are connected via pipelines to a temperature adjuster 111 outside of the vacuum vessel 101. The temperature adjuster 111 adjusts, according to instruction signals from the controller 112, the flow rate and the temperature of refrigerant circulating through the refrigerant paths 203.

Description will now be given of structure of the dielectric film section 202 made of a dielectric material, e.g., $Al_2O_3$. The dielectric film section 202 mainly includes three layers, i.e., an upper layer, an intermediate layer, and a lower layer. The upper layer includes a disk-shaped member which includes therein an electrostatic-chuck electrode and which serves as a wafer mounting surface. The lower layer includes, on an upper surface of the disk-shaped basic section 201, a plurality of dielectric films including therein a film-shaped heater. The intermediate layer is an adhesive layer and is interposed between the upper and lower layers to connect the upper and lower layers thereto.

In the embodiment, to fully tightly fix the lower layer onto the upper surface of the basic section 201, the lower layer is formed through a plasma spray process using a dielectric material. The film-shaped heater is also formed through a plasma spray process.

In the embodiment, the disk-shaped member of the upper layer is a sintered ceramic plate 209. The sintered ceramic plate 209 is produced by sintering a ceramic material of, e.g., $Al_2O_3$ or $Y_2O_3$ into a disk having a predetermined thickness and a predetermined diameter. In the sintered ceramic plate 209, there is arranged an electrostatic-chuck electrode film 208 which generates electrostatic force when supplied with dc power. On a lower surface of the sintered ceramic plate 209, there is disposed a connector section electrically coupled with the electrostatic-chuck electrode film 208. In a state in which the connector is fixed via the basic section 201 to the sample stage 107, the connector is connected to the electrostatic-chuck-electrode dc power source 110.

In the dielectric film of the lower layer, a first dielectric film 204 of, e.g., $Al_2O_3$ is formed on the basic section 201 through a plasma spray process. Thereafter, a metallic material is plasma-sprayed thereonto in a predetermined contour to thereby produce a heater electrode film 205. In the plasma spray process to form the heater electrode film 205 on the first dielectric film 204, a mask is employed to obtain a predetermined contour to realize the temperature distribution in the wafer or the wafer mounting surface. The metallic material to be sprayed to form the heater electrode film 205 may be tungsten or a material of which resistivity is controlled, for example, a nickel-chrome alloy or nickel-aluminum alloy with controlled resistivity or a material obtained by mixing additive metal in tungsten to control its resistivity.

In each of the films formed through the plasma spray process, fine particles of the molten or quasi-molten materials are sprayed onto a surface of the object to be coated therewith. The particles collide with the surface and are deformed by impulse of the collision. The deformed particles are piled on the surface to resultantly form a film. At collision, the particles with molten surfaces make contact with each other and are fused with each other. Between the particles, there exist fine spaces. Hence, it is not likely that the member is partly lost or is cracked due to deformation thereof, e.g., expansion and contraction. That is, the member has relatively low brittleness. Also, it is easy to change the contour of the film, for example, through a cutting process.

In the embodiment, after the material of the heater electrode film 205 is sprayed according to the mask contour, the obtained film is reduced in thickness through a cutting process to uniformalize the quantity of heat generated per unitary area for each location in the overall film area. As a result, the quantity of heat thus generated is uniformalized in the area in which the heater electrode film 208 is disposed. This suppresses variation in the temperature distribution in the circumferential and radial directions of the wafer.

Onto the first dielectric film 204 and the heater electrode film 205, a dielectric material such as $Al_2O_3$ is again plasma-sprayed to form a second dielectric film 206. It is also possible that an upper surface of the second dielectric film 206 is adjusted through a cutting process such that distance between the upper surface of the heater electrode film 205 and that of the second dielectric film 206 is uniform in the overall area in which the heater electrode film 205 is arranged.

Before forming the lower films by the plasma spray process, the upper film, i.e., the sintered ceramic plate 209 is separately sintered. In the embodiment, the electrostatic-chuck electrode film 208 is arranged in two areas in the sintered ceramic plate 209, specifically, in a central section and a ring-shaped outer circumferential section viewed from above. These areas are electrically coupled with the electrostatic-chuck-electrode dc power source 110 and are supplied mutually different values of power therefrom.

The sintered ceramic plate 209 includes, in an intermediate section sandwiched by ceramic materials in the thickness direction, an electrostatic-chuck electrode film 208 including a metallic material, for example, tungsten. A ceramic material shaped into a disk with the electrode film 208 included therein is sintered under a condition such that the disk has a thickness ranging from about 0.2 mm to about 0.4 mm when the disk is cooled down.

The second dielectric film 206 thus shaped in a predetermined contour is then coated with a silicone-based adhesive material 207. The sintered ceramic plate 209 is pushed against the lower layer including the first and second dielectric films 204 and 206 and the heater electrode film 205 with the layer of the adhesive material 207 therebetween to be fixed to each other into one unit. The heater electrode film 205 and the electrostatic-chuck electrode film 208 are connected respectively to the heater-electrode dc power source 109 and the electrostatic-chuck-electrode dc power source 110. The basic section 201 is connected to the bias power source 108. In the embodiment, it is also possible that the electrostatic-chuck electrode film 208 is disposed in a lower-most section in the thickness direction of the sintered ceramic plate 209 such that the electrode film 208 is exposed in a lower surface of the sintered ceramic plate 209.

The sintered ceramic plate 209 serves as the wafer mounting surface of the sample stage 107 and is exposed to the plasma generating space in the processing chamber 103. Hence, in a situation in which when plasma is generated in the plasma generating space of the processing chamber 103 to remove foreign particles attached onto inside surfaces of the processing chamber 103 and if the wafer mounting surface is not covered with a cleaning wafer, the wafer mounting surface of the sintered ceramic plate 209 is affected by interaction with the plasma. This aggravates wear, damage, and contamination of the wafer mounting surface. As the number of wafers processed by the plasma processing apparatus for products becomes larger, the damage and the contamination become worse in the upper surface of the sintered ceramic plate 209 serving as the wafer mounting surface due to the temperature difference between the heating state and the cooling state and the interaction with the reactive gas.

Aggravation in the contamination and the damage deteriorates precision in the processing of wafers and lowers yield in the production of wafers. Hence, when a predetermined number of wafers are processed or when a predetermined period of time passes during the operation of the plasma processing apparatus, the wafer mounting surface is cleaned to a normal state. In the embodiment, to replace the sintered ceramic plate 209 in the state described above by a new sintered ceramic plate, the old sintered ceramic plate 209 is removed from the upper section of the sample stage 107. In this situation, the members of the sample stage 107 including the basic section 201 and the dielectric film section 202 are treated as one block to be removed from the processing chamber 103. Thereafter, an associated new block of the sample stage 107 is attached. In the old block thus replaced, the sintered ceramic plate 209 is removed from the main body of the sample stage 107 at the position of the adhesive material 207.

After the sintered ceramic plate 209 is removed as above, the adhesive material 207 partly remains on the upper surface of the sample stage 107 or the second dielectric film 206 of the lower layer is exposed in the upper surface thereof. Hence, on the block side of the sample stage 107, the adhesive material 207 and the second dielectric film 206 are removed through a polishing or cutting process. Thereafter, the second dielectric film 206 is formed through a plasma spray process and the adhesive material 207 is formed through a coating process to be connected to a new sintered ceramic plate 209 separately prepared. The block of the sample stage 107 prepared in this way is employed as a replacing sample stage 107 and will replace a used sample stage 107 required to be replaced because the predetermined number of wafers have been processed or the predetermined period of time has passed.

In the basic section 201, a hole is disposed upwardly from the bottom thereof. To sense temperature on the upper surface of the basic section 201, a temperature sensor 210 is arranged in the hole. The temperature sensor 210 includes a thermocouple or a platinum temperature-measuring resistor. The temperature sensor 210 senses the temperature and sends the value of temperature via a communication unit to the controller 112. In the controller 112, the arithmetic unit determines the temperature value of the basic section 201. Based on the temperature value, a program in the controller 112 or a program stored in an external storage such as a hard disk communicably connected to the controller 112 predicts the temperature value or the temperature distribution of the upper surface of the sintered ceramic plate 209 or the wafer placed thereon.

The controller 112 calculates, by use of a program beforehand stored in the storage, the value of power to be supplied from the heater-electrode dc power source 109 according to the temperature of the sintered ceramic plate 209 or the wafer. To obtain the value of power from the heater-electrode dc power source 109, the controller 112 issues an instruction to the heater-electrode dc power source 109, to thereby adjust the quantity of heat generated by the heater electrode film 205. As above, according to the present embodiment, the sensed temperature of the sample stage 107 is fed back to the controller 112. As a result, the output from the heater electrode film 205 is adjusted to obtain an appropriate temperature or an appropriate temperature distribution of the wafer for the process thereof.

In the embodiment, between the processes of films as processing objects formed on a wafer, the temperature distribution or profile is appropriately changed in the direction of the wafer surface for the associated process. After an upper film is completely processed, the system stops processing such as the processing to supply the bias power from the bias power source 108 until the temperature profile suitable for the upper film is changed to that suitable for a lower film for the following reason. That is, if the lower film is processed before the temperature profile suitable for the lower film is realized, the temperature condition is not suitable for the process. Hence, the contour of the film after the process greatly varies from an expected contour. To improve efficiency of the processing, it is quite important to change the temperature profile in a short period of time.

To change the temperature profile in a shorter period of time, it is desirable to reduce heat capacity of a section of the sample stage 107 ranging from the heater electrode film 205 to the electrode surface. To realize such temperature profile change according to the embodiment, the thickness of the sintered ceramic plate 209 is controlled in a predetermined range. On the other hand, to lower the heat capacity, it is desirable to reduce the thickness of the sintered ceramic plate 209 to the maximum extent. However, since a voltage to electrostatically chuck the wafer is applied to the electrostatic-chuck electrode film 208 in the sintered ceramic plate 209, the thickness of the sintered ceramic plate 209 is limited to a lower-most value at which insulation breakdown takes place when the voltage is applied thereto.

According to findings obtained through discussion, the present inventors compare the electric field which is formed over the sintered ceramic plate 209 in association with the voltage applied to the electrostatic-chuck electrode film 208 to obtain the chuck force necessary to fix the wafer by the electrostatic chuck with the electric field which does not cause the insulation breakdown in the ceramic material of the sintered ceramic plate 209. Based on a result of the comparison, it is determined that the thickness of the sintered ceramic plate 209 is at least about 0.2 mm. Also, based on the period of time required to change the wafer temperature between the films as processing objects, it is determined that the sintered ceramic plate 209 capable of achieving the required performance has a thickness of at most about 0.4 mm.

According to the embodiment, to realize the required temperature uniformity in the wafer surface, the heater electrode film 205 is formed through a plasma spray process to adjust thickness of respective locations thereof viewed from above to thereby improve the uniformity in the distribution of heat generated by the heater electrode film 205 in the surface direction of the wafer or the wafer mounting surface. By adjusting the quantity of heat generated by the heater electrode film 205 for each area, it is possible to improve the uniformity in the temperature in the wafer surface.

Figure 3A:
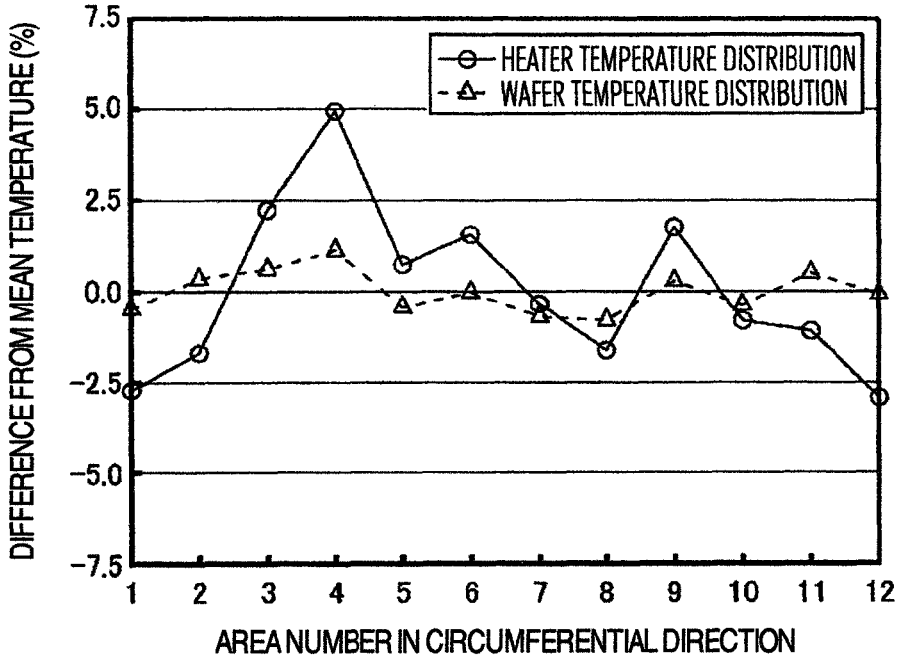
FIG. 3A is a graph showing temperature distributions of a heater and a wafer in the circumferential direction according to the prior art.
Figure 3B:
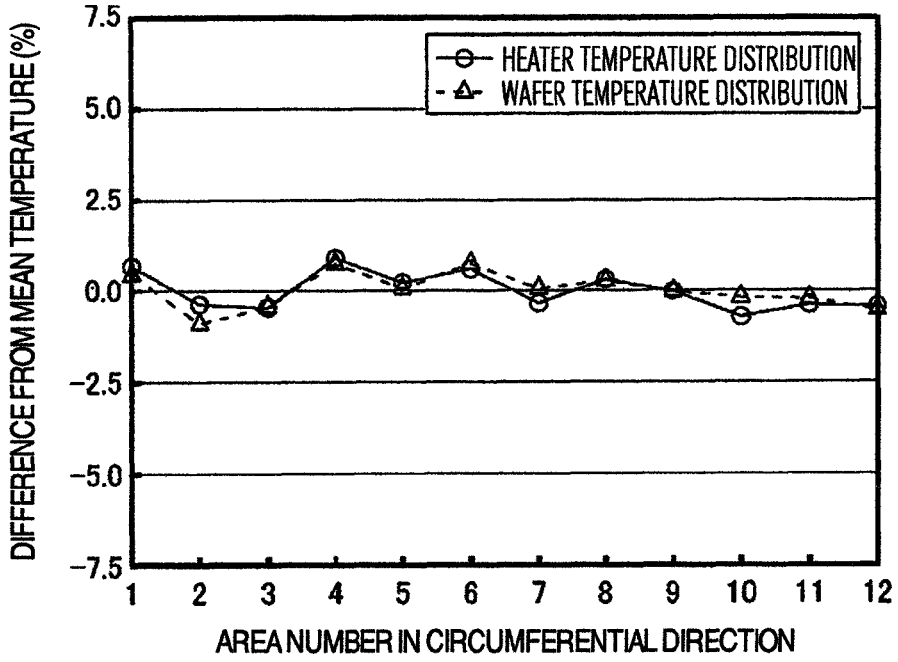
FIG. 3B is a graph showing temperature distributions of a heater and a wafer in the circumferential direction according to the embodiment.

FIG. 3A is a graph showing temperature distributions of a heater and a wafer in the circumferential direction according to the prior art. FIG. 3B is a graph showing temperature distributions of a heater and a wafer in the circumferential direction according to the embodiment. For the graphs, the temperature distributions of the heater electrode film 205 and the wafer are obtained as follows. The wafer is circumferentially subdivided into twelve areas to calculate a mean value of temperature for each area. The difference between the mean value and the overall mean value of the wafer is divided by the overall mean value to obtain a ratio of the difference. The abscissa represents the area number of each area obtained by dividing the wafer in the circumferential direction and the ordinate represents the ratio of the difference relative to the overall mean value.

As can be seen from FIG. 3A, in the sample stage of the prior art, the quantity of heat generated by the heater greatly varies between areas prepared by subdividing the wafer in the circumferential direction as above. That is, the temperature considerably varies in the heater layer. Hence, it is required that the temperature is more uniformalized by use of the heat uniformalization effect of a thick sintered ceramic plate or by installing a heat uniformalizing plate, to thereby uniformalize the wafer temperature in the wafer surface, the wafer temperature being required to process the wafer. In the sample stage of the embodiment shown in FIG. 3B, the distribution of heat generated by the heater is uniformalized by adjusting the film thickness of the heater electrode film 205. Hence, the quantity of heat generated by the heater is uniformalized for each area of the sample mounting surface.

By securing the uniformity of the wafer temperature in the wafer surface through the uniformalization of the quantity of heat generated by the heater and by reducing the heat capacity of the section ranging from the heater electrode film 205 to the electrode surface, the temperature difference between the wafer surface temperature and the surface temperature of the heater electrode film 205 or the upper section of the basic section 201 and the response time difference therebetween are reduced. For example, in a continuous operation to continuously process a section ranging from a hard mask to a metallic layer, the temperature is lowered for the metallic layer. When the conventional sample stage is employed in the operation, the heat capacity per unitary surface area of the dielectric material between the heater and the sample stage surface is large. Hence, a relatively long response time is required from when the heat generated by the heater is changed to when the appropriate stable temperature is realized for the wafer.

According to the present embodiment, the thickness of the sintered ceramic plate 209 is controlled in the range described above to lower the heat capacity per unitary area in a section ranging from the heater electrode film 205 to the sample stage surface. Hence, the wafer temperature and the temperature of the upper surface of the basic section 201 or the temperature detected by the temperature sensor 210 vary at almost an equal rate. It is therefore possible to change the wafer temperature to a temperature suitable for the wafer process, to thereby suppress the reduction in the CD manufacturing precision.

Figure 4:
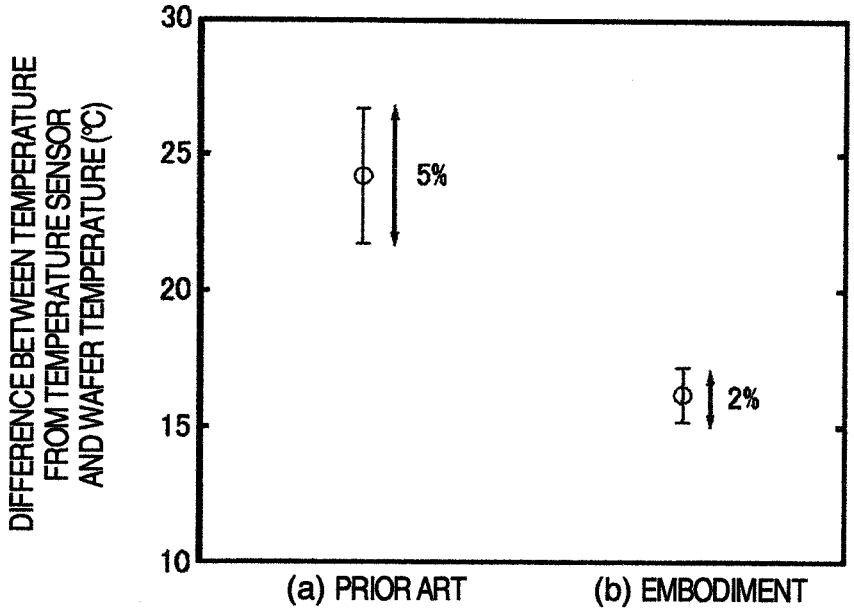
FIG. 4 is an explanatory diagram to explain the difference between a sensed value from a temperature sensor and a temperature value of a wafer for each of the prior art and the embodiment.

FIG. 4 is an explanatory diagram to explain the difference between a sensed value from a temperature sensor and a temperature value of a wafer for each of the prior art and the embodiment. FIG. 4 shows the temperature difference between the sensed value from the temperature sensor 210 disposed in the upper section of the basic section 201 and the wafer temperature and an error of the wafer temperature estimated on the basis of the output from the temperature sensor 210. Specifically, when the temperature sensor 210 outputs substantially an equal temperature in the prior art and the present embodiment, the temperature difference between the wafer temperature and the sensed temperature is plotted along the ordinate. The error of the wafer temperature estimated on the basis of the output from the temperature sensor 210 in this situation is vertically indicated with a line which passes an associated marker thus plotted.

In the embodiment, since the thermal resistance in a section ranging from the temperature sensor 210 to the wafer is small, the temperature difference between the temperature sensor 210 and the wafer is reduced when compared with the prior art. It is possible that the output from the temperature sensor 210 is fed back to use an estimated value less apart from the actual wafer value. Based on the estimated value, the output from the temperature adjuster 111 or the heater-electrode dc power source 109 is adjusted to control the surface temperature of the sintered ceramic plate 209 or the temperature of the wafer. It is hence possible to obtain an appropriate temperature value of the wafer or the sample mounting surface and an appropriate temperature distribution thereof with higher precision. Since the number of constituent components is reduced, it is possible to reduce the error of the estimated value of the wafer temperature associated with the temperature sensor 210. This advantageously reduces the CD variation in the wafer surface. When such sample stages 107 are produced, the variation of the thermal resistance between the heater electrode film 205 and the sample mounting surface becomes smaller between the respective sample stages 107, Hence, the so-called machine difference between the respective plasma processing apparatuses is reduced.

According to the embodiment, it is possible to provide an electrode which can highly sustain uniformity of the wafer temperature in the wafer surface and which can change the wafer temperature in a shorter period of time between the respective films during the wafer processing operation, to thereby prevent reduction in the CD manufacturing precision. The electrode also can control the wafer temperature with high precision to resultantly improve uniformity in the manufacturing of the wafers.

Since the thickness of the sintered ceramic plate serving as the sample stage surface ranges from about 0.2 mm to about 0.4 mm, the heat capacity of the section from the plasma spray heater disposed in the sample stage to the wafer as the processing object becomes smaller. Hence, the period of time required to control the wafer temperature by the plasma spray heater can be reduced. Therefore, it is expectable that the throughput is improved due to reduction in the wafer processing time. The wafer manufacturing precision is increased since the period of time for the stabilization of the wafer temperature is secured. The uniformity of the wafer temperature required to process wafers can be realized by uniformalizing the quantity of heat generated by the plasma spray heater even if the heat uniformalizing effect cannot be expected due to reduction in the thickness of the sintered ceramic plate. Since the thickness of the sintered ceramic plate is reduced as compared with the prior art, the distance between the temperature sensor disposed in the basic section and the sample stage surface becomes smaller. This reduces the variation in the thermal resistance of the section ranging from the temperature sensor to the sample stage surface, to thereby improve precision in the control of the wafer temperature based on the sensed temperature from the temperature sensor.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A plasma processing apparatus, in which a wafer is placed on a sample stage disposed in a processing chamber in a vacuum vessel, and the wafer is processed by use of plasma generated in the processing chamber, the plasma processing apparatus comprising:

a metallic basic member arranged in the sample stage, the metallic basic member having a refrigerant path therein, the refrigerant path configured to enable refrigerant to flow therethrough;

a dielectric film made of dielectric material and disposed on an upper surface of the metallic basic member, the dielectric film being formed through a plasma spray process, the dielectric film being configured to have a thickness for making a quantity of heat generated per unit area of the upper surface of the dielectric film in at least one of a radial direction and a circumferential direction thereof, wherein the dielectric film includes:

a first dielectric film formed through the plasma spray process on an upper surface of the metallic basic member;

a second dielectric film formed through the plasma spray process on an upper surface of the first dielectric film so as to be above a film-shaped heater; and the film-shaped heater disposed in the dielectric film between the first dielectric film and the second dielectric film, the heater being made of a metal and formed through a plasma spray process and thereafter adjusted a thickness thereof in at least one topical area of a region where the film-shaped heater is disposed;

an adhesive layer arranged on the dielectric film;

a sintered ceramic plate adhered onto the dielectric film via the adhesive layer disposed between the sintered ceramic plate and the dielectric film, the sintered ceramic plate having therein, or on a lower surface thereof, an electrostatic- chuck electrode film configured to conduct an electrostatic-chuck operation between a lower surface of the wafer and an upper surface of the sintered ceramic plate;

a sensor disposed in the metallic basic member for sensing a temperature; and a controller configured to receive an output from the sensor and to adjust a quantity of heat generated by the heater by use of feedback control using data detected from output of the sensor;

wherein the dielectric film has the thickness thereof such that the quantity of heat generated per a unit area of the upper surface thereof is configured to be uniform in at least one of a radial direction and a circumferential direction thereof after the second dielectric film is formed through the plasma spray process on an upper surface of the first dielectric film and the film-shaped heater and before the sintered ceramic plate is adhered onto the dielectric film via the adhesive layer.

2. A plasma processing apparatus according to claim 1, wherein the electrostatic-chuck electrode film is disposed in the sintered plate, and configured to conduct an electrostatic-chuck operation.

3. A plasma processing apparatus according to claim 1, wherein the film-shaped heater disposed in the dielectric film between the first dielectric film and the second dielectric film is formed through a plasma spray process and thereafter the thickness adjusted such that the quantity of heat generated per a unit area thereof is configured to be uniform in at least one of a radial direction and a circumferential direction of a range where the heater is disposed inside the dielectric film, and the second dielectric film is formed through the plasma spray process on an upper surface of the first dielectric film and the film-shaped heater after the adjustment of the thickness of the film-shaped heater, and thereafter the thickness adjusted thereof such that the quantity of heat generated per a unit area of the upper surface of the second dielectric film is configured to be uniform in at least one of a radial direction and a circumferential direction thereof.

4. A plasma processing apparatus according to claim 3, wherein the electrostatic-chuck electrode film is disposed in the sintered plate, and configured to conduct an electrostatic-chuck operation.

5. A sample stage according to claim 1, wherein the film-shaped heater disposed in the dielectric film between the first dielectric film and the second dielectric film is formed through a plasma spray process and thereafter the thickness adjusted such that the quantity of heat generated per a unit area thereof is configured to be uniform in at least one of a radial direction and a circumferential direction of a range where the heater is disposed inside the dielectric film, and the second dielectric film is formed through the plasma spray process on an upper surface of the first dielectric film and the film-shaped heater after the adjustment of the thickness of the film-shaped heater, and thereafter the thickness adjusted thereof such that the quantity of heat generated per a unit area of the upper surface of the second dielectric film is configured to be uniform in at least one of a radial direction and a circumferential direction thereof.

6. A sample stage according to claim 5, wherein the electrostatic-chuck electrode film is disposed in the sintered plate, and configured to conduct an electrostatic-chuck operation.

7. A sample stage, which is disposed in a processing chamber in a vacuum vessel, and on which a wafer to be processed by use of plasma generated in the processing chamber is placed, the sample stage comprising:

a metallic basic member arranged in the sample stage, the metallic basic member having a refrigerant path therein, the refrigerant path configured to enable refrigerant to flow therethrough;

a dielectric film made of dielectric material and disposed on an upper surface of the metallic basic member, the dielectric film being formed through a plasma spray process, the dielectric film being configured to have a thickness for making a quantity of heat generated per unit area of the upper surface of the dielectric film in at least one of a radial direction and a circumferential direction thereof, wherein the dielectric film includes:

a first dielectric film formed through the plasma spray process on an upper surface of the metallic basic member;

a second dielectric film formed through the plasma spray process on an upper surface of the first dielectric film so as to be above a film-shaped heater; and the film-shaped heater disposed in the dielectric film between the first dielectric film and the second dielectric film, the heater being made of a metal and formed through a plasma spray process and thereafter adjusted a thickness thereof in at least one topical area of a region where the film-shaped heater is disposed;

an adhesive layer arranged on the dielectric film;

a sintered ceramic plate adhered onto the dielectric film via the adhesive layer disposed between the sintered ceramic plate and the dielectric film, the sintered ceramic plate having therein, or on a lower surface thereof, an electrostatic-chuck electrode film configured to conduct an electrostatic-chuck operation between a lower surface of the wafer and an upper surface of the sintered ceramic plate; and a sensor disposed in the metallic basic member for sensing a temperature, wherein the sensor is connected to a controller configured to receive an output from the sensor and to adjust a quantity of heat generated by the heater by use of feedback control using data detected from output of the sensor wherein the dielectric film has the thickness thereof such that the quantity of heat generated per a unit area of the upper surface thereof is configured to be uniform in at least one of a radial direction and a circumferential direction thereof after the second dielectric film is formed through the plasma spray process on an upper surface of the first dielectric film and the film-shaped heater and before the sintered ceramic plate is adhered onto the dielectric film via the adhesive layer.

8. A sample stage according to claim 7, wherein the electrostatic-chuck electrode film is disposed in the sintered plate, and configured to conduct an electrostatic-chuck operation.

* * * * *